US006935131B1

(12) United States Patent
Backman

(10) Patent No.: US 6,935,131 B1
(45) Date of Patent: Aug. 30, 2005

(54) DESICCANT ASSISTED DEHUMIDIFICATION SYSTEM FOR AQUEOUS BASED LIQUID REFRIGERANT FACILITIES

(76) Inventor: Tom Backman, 4915 Arendell St., #313, Morehead City, NC (US) 28557

( * ) Notice: Subject to any disclaimer, the term of this patent is extended or adjusted under 35 U.S.C. 154(b) by 12 days.

(21) Appl. No.: 10/711,301

(22) Filed: Sep. 9, 2004

(51) Int. Cl.[7] ..... F25D 23/00
(52) U.S. Cl. ..... 62/271; 62/93; 62/235; 62/332; 62/435
(58) Field of Search ..... 62/93, 94, 235, 62/271, 332, 430, 435

(56) References Cited

U.S. PATENT DOCUMENTS

| | | | | |
|---|---|---|---|---|
| 3,878,694 A | | 4/1975 | Holmsten | 62/235 |
| 5,042,262 A | | 8/1991 | Gyger et al. | 62/434 |
| 5,170,633 A | * | 12/1992 | Kaplan | 62/94 |
| 5,460,004 A | | 10/1995 | Tsimerman | 62/94 |
| 5,695,004 A | | 12/1997 | Beckwith | 165/104 |
| 5,732,562 A | * | 3/1998 | Moratalla | 62/94 |
| 5,802,864 A | | 9/1998 | Yarbrough et al. | 62/430 |
| 5,901,563 A | | 5/1999 | Yarbrough et al. | 62/234 |
| 6,029,467 A | | 2/2000 | Moratalla | 62/93 |
| 6,321,551 B1 | | 11/2001 | Backman et al. | 62/235 |

* cited by examiner

*Primary Examiner*—Melvin Jones
(74) *Attorney, Agent, or Firm*—Mills Law Firm PLLC

(57) ABSTRACT

An indoor facility provided with a liquid refrigerant dehumidifier coil connected with the main refrigeration coils in a secondary refrigerant loop and a compressor waste heat coil coupled with the primary refrigerant loop and heating a desiccant wheel for removing further humidity from the process air stream.

7 Claims, 1 Drawing Sheet

DESICCANT ASSISTED DEHUMIDIFICATION SYSTEM FOR AQUEOUS BASED LIQUID REFRIGERANT FACILITIES

FIELD OF THE INVENTION

The present invention relates to dehumidification and, in particular, to a system using aqueous based secondary loop cooling augmented with a low temperature range desiccant system for controlling excess humidity under extreme or revised operating conditions.

BACKGROUND OF THE INVENTION

Indoor facilities employing freezing, cooling or refrigeration loads can present significant dehumidification problems. Indoor ice arenas and supermarkets present particular concerns. In ice arenas, the ice rink surface is maintained at subfreezing temperatures by a liquid secondary cooling loop, customarily utilizing glycol as the liquid refrigerant. The ice surface and spectators and participants generate a substantial humidity load that can result in undesirable condensation, particularly under extreme environmental temperature and humidity conditions and to the detriment of equipment and attendant personnel comfort. Similarly, the freezer, cooler, and refrigeration equipment, and customers in supermarkets generate substantial humidity loads creating like equipment and personnel problems.

An improved energy efficient air handling system for maintaining humidity levels in ice rink facilities is disclosed in my prior patent, U.S. Pat. No. 6,321,551. Therein, the process air stream is cooled and dehumidified at a dehumidifier unit serially connected with the ice rink coils, and reheated by a waste heat exchanger to a low return temperature. The system significantly reduces the parasitic heating by the return air resulting in dramatically lowered utility costs, and handles substantial dehumidification loads.

There is a current trend, however, at the state and municipal regulatory level to mandate increases in the amount of exterior make up air in the return air flow to the above facilities. This added make up air volume establishes an incremental dehumidification burden that can exceed the capabilities of the existing equipment. To avoid the need for upsizing the equipment and thus increasing capital and operating costs, it would be desirable to utilize the thermal benefits of the patented system while handling the increased dehumidification requirements.

SUMMARY OF INVENTION

The present invention addresses and overcomes the aforementioned problems and limitations by supplementing the dehumidification unit in the process air stream with a desiccant rotor operating in temperature ranges substantially below current practice. The regeneration portion of the rotor is heated, without flame, by a reheat coil coupled with a waste heat line from the compressor in the primary loop. Inasmuch as these compressors are in the range of 110 to 600 hp. substantial waste heat is available allowing reheating to a regeneration temperature in the range of about 50° to 100°. These temperatures are substantially below the regeneration temperature of conventional desiccant systems that are flame heated operate at regeneration temperatures of about 200° to 350° F. and require substantial heating costs. This regeneration temperature provides sufficient desiccant media capacity to remove further moisture from the process air stream exiting the liquid cooled dehumidification coil while reheating the dehumidifiedreturn air to a satisfactory supply temperature of about 60° to 80° F.

DESCRIPTION OF DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
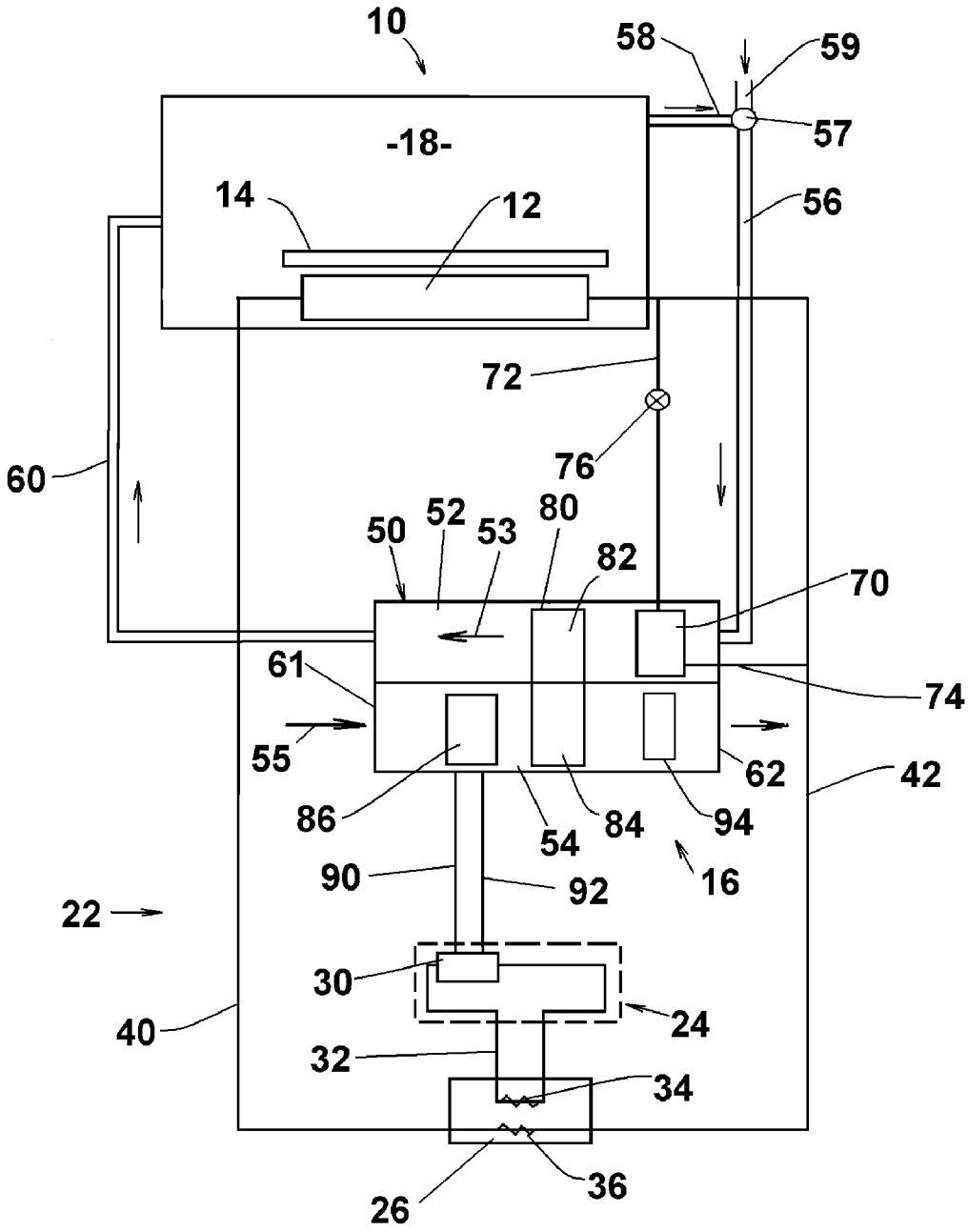
FIG. 1 is a schematic diagram of a desiccant assisted dehumidification system for secondary liquid refrigerant facilities in accordance with the present invention.

Referring to the FIG. 1 for the purpose of describing a preferred embodiment of the present invention and not for limiting same, there is shown an indoor facility 10 having a cooling coil array 12 coupled with a cooling load 14 and provided with a desiccant assisted dehumidification system 16 for establishing and maintaining humidity levels within the enclosed space 18 of the facility 10 to prevent condensation and provide personnel comfort. The present embodiment will be described with reference to an ice rink facility wherein the cooling load is the ice rink, and the coil array is the underlying rink coils. For other applications such as supermarkets and like commercial facilities, the cooling load is the refrigerated equipment and the cooling load are the various refrigeration coils associated therewith.

The ice rink facility 10 is provided with underlying rink coils 12 connected in a liquid refrigerant secondary refrigeration system 22 thermally coupled with a direct vaporization primary refrigeration system 24 at a heat exchanger 26 for maintaining the ice rink 14 at a temperature establishing a skating surface suited for the activities conducted thereon. The liquid refrigerant employed in the secondary refrigeration system is typically an aqueous based glycol or brine.

The primary refrigeration system 24 includes a compressor 30 connected in fluid line 32 with the primary coil 34 of the heat exchanger 26. The secondary refrigeration system 22 includes a secondary coil 36 at the heat exchanger 26 connected to a main supply line 40, which is connected to the inlet of the rink coils 12. The outlet of the rink coils 12 is connected with a main return line 42.

The system 16 includes an air handler 50 having a process conduit 52 conducting a process stream 53 in the direction of the arrows and a regeneration conduit 54 conducting a regeneration stream 55 in the direction of the arrows. The inlet of the process conduit 52 is connected with the enclosure 18 of the facility 10 by a return line 56. The return line 56 is connected at connection 57 to exterior line 58 exhausting humidified air from the facility and make up line 59 admitting air from exterior of the facility. The outlet of the process conduit 52 is connected with the enclosure 18 of the facility 10 by supply conduit 60. The regeneration conduit 54 has an inlet flow 61 obtained interior or exterior of the facility 10 and an outlet flow 62 discharging exterior of the facility.

A dehumidifier coil 70 is disposed in the process conduit 52 adjacent the return line 56. The coil 70 is connected in parallel to the return line 42 of the secondary refrigeration system 22 by inlet line 72 and outlet line 74. A control valve 76 maintains the coil 70 at a temperature of below about 36° F., preferably 34° F. or below, with below freezing coil temperatures achievable with coil defrost cycles.

A conventional rotating desiccant wheel 80 includes a reheat sector 82 disposed in the process conduit 52 and a dehumidification sector 84 disposed in the regeneration conduit 54. The reheat sector 82 is effective for absorbing moisture from the process air stream exiting the dehumidifier coli 70 and raising the temperature of the air stream entering the supply conduit 60. A waste heat exchanger 86 is disposed in the process conduit 52 upstream of a dehumidification sector 84 of the desiccant wheel 80. The waste heat exchanger 86 is effective to raise the temperature of the dehumidification sector 84 to expel absorbed moisture therefrom for delivery to the exit stream. The waste heat exchanger 86 is thermally coupled by lines 90, 92 with the compressor 30 for transferring waste heat therefrom. A fan 94 in the regeneration conduit 54 establishes and regulates fluid flow in the conduit 52.

In the regeneration sector, the desiccant is heated to a regeneration temperature in the range of about 50° to 100° F. This range is substantially below conventional desiccant systems that are flame heated to operate at regeneration temperatures of about 200° to 350° F., which correlates to a supply temperature of about 110° to 135° F. The waste heat generated by the large horsepower compressor is sufficient for such reheat. This regeneration temperature provides a desiccant media capacity for removing further moisture from the process air stream 53 exiting the dehumidification coil 70 and to reheat the return air to a supply or process return temperature of about 50° to 70°. This capacity gives the system sufficient capability to handle variable amounts of makeup air without resizing of the secondary refrigeration system or air handler equipment as illustrated by the following example.

EXAMPLE 1

An ice rink facility requires a total air flow of 10,000 SCFM and a return air supply temperature at a dew point of 34° F. to avoid condensation effects. Under original code, a 20% outdoor air flow was required. Under new code regulations, a 30% outdoor air flow is required. The facility is provided with an existing system in accordance with the '221 patent. The new system incorporates the desiccant assist of the present invention.

Results

| Description | Old Code Orig. Sys. | New Code Orig. Sys. | New Code New Sys. |
|---|---|---|---|
| Total Air Flow SCFM | 10,000 | 10,000 | 10,000 |
| Return Air Flow SCFM | 8,000 | 7,000 | 7,000 |
| Outdoor Air Flow SCFM | 2,000 | 3,000 | 3,000 |
| Coil Cooling Capacity, tons | 35.8 | 35.8 | 35.8 |
| Coil Moisture Removal, lb/hr | 150.8 | 155.5 | 155.5 |
| Coil Dew Point, Deg. F. | 34 | 38 | 38 |
| Desiccant Moisture Removal, lb/hr | 0 | 0 | 35.5 |
| Total Moisture Removal, lb/hr | 150.8 | 155.5 | 190.0 |
| System Dew Point, Def. F | 34 | 38 | 34 |
| Supply Air Temp., Deg. F. | 65 | 65 | 65 |

The foregoing demonstrates that the existing system, while able to handle the original operating conditions, is not able to handle the increase of outdoor air flow without raising the dew point, i.e. 38 deg F., to a level where adverse condensation effects occur. On the other hand, keeping the in-place equipment and supplementing with only the desiccant system allows facility to maintain acceptable dew point and supply air temperatures.

Suitable aqueous based refrigeration fluids suitable for the secondary system include: glycol solutions comprising ethylene glycol and propylene glycol; and brines comprising calcium chloride, sodium chloride and organic salt materials.

The above description is intended to be illustrative of the preferred embodiment, and modifications and improvements thereto will become apparent to those in the art. Accordingly, the scope of the invention should be construed solely in accordance with the appended claims.

What is claimed is:

1. In an indoor facility having an enclosed volume to be humidity controlled, a dehumidification system comprising: an air handling system having a process conduit and a regeneration conduit, a return line fluidly connecting the enclosed volume with an inlet of said process conduit and establishing a process air flow therethrough; means for supplying ambient air to said return line; a supply line fluidly connecting an outlet of said process conduit with the enclosed volume; an aqueous liquid refrigeration system for maintaining a cooling load in said volume; a dehumidification coil in said process conduit operatively connected with said liquid refrigeration system; rotating desiccant means in said air handling system having a first portion disposed in said process conduit and a second portion disposed in said regeneration conduit; fan means in said regeneration conduit for conducting ambient air from an inlet to an outlet; a primary refrigeration system including a compressor thermally coupled with said secondary refrigeration system; waste heat exchange means in said regeneration conduit thermally coupled with said compressor for heating said second portion of said desiccant means to an elevated temperature in said regeneration conduit and for thereby removing in said process conduit a first portion of moisture from said process air flow; and dehumidification means in said process conduit for reheating and removing a second portion of moisture from said process air flow supplied to said supply line.

2. The system as recited in claim 1 wherein said waste heat exchange means heats said second portion of said desiccant means to about 50 to 100° F. deg.

3. The system as recited in claim 2 wherein said reheating in said process conduit heat said process air flow to about 50 to 70° F. deg.

4. The system as recited in claim 3 wherein said liquid refrigeration system uses a refrigerant liquid selected from the group of glycols and brines.

5. The system as recited in claim 4 wherein said glycols includes ethylene glycol and propylene glycol.

6. The system as recited in claim 4 wherein brines include calcium chloride, sodium chloride or organic salt solutions.

7. A dehumidification system for an indoor facility having a cooling load coupled with a secondary liquid refrigeration system which is coupled with a direct expansion refrigeration system including a compressor generating waste heat, a dehumidification system comprising: air handling means having a process flow means and a regeneration flow means, said process flow means receiving humid air from said facility and returning dehumidified air to said facility, said regeneration flow means discharging air to the exterior; dehumidification coil means thermally coupled with said secondary liquid refrigeration system in said process flow means for removing a first portion of moisture from said humid air to a dew point of below about 36° F.; desiccant means in said air handling means rotating between said process flow means and said regeneration flow means, said desiccant means removing a second portion of moisture from said humid air received in said process flow means from said dehumidification coil means and for reheating said humid air to about 50 to 70° F., said desiccant means in said regeneration flow means being heated to about 50 to 100° F. and discharging said second portion of moisture to said regeneration flow means.

* * * * *